US007973518B2

(12) United States Patent
Shor et al.

(10) Patent No.: US 7,973,518 B2
(45) Date of Patent: Jul. 5, 2011

(54) LOW NOISE VOLTAGE REGULATOR

(75) Inventors: Joseph Shor, Tel Mond (IL); Adam Zaidel, Jerusalem (IL); Noam Familia, Modiin (IL)

(73) Assignee: Intel Corporation, Santa Clara, CA (US)

( * ) Notice: Subject to any disclaimer, the term of this patent is extended or adjusted under 35 U.S.C. 154(b) by 504 days.

(21) Appl. No.: 12/133,908

(22) Filed: Jun. 5, 2008

(65) Prior Publication Data

US 2009/0302812 A1 Dec. 10, 2009

(51) Int. Cl.
*G05F 1/618* (2006.01)

(52) U.S. Cl. ..... 323/224; 323/270; 323/280

(58) Field of Classification Search ..... 323/224, 323/270, 273, 275, 280, 281
See application file for complete search history.

(56) References Cited

U.S. PATENT DOCUMENTS 5,552,697 A 9/1996 Chan
5,608,312 A 3/1997 Wallace
5,864,227 A * 1/1999 Borden et al. ..... 323/280
6,696,822 B2 * 2/2004 Takabayashi ..... 323/224
6,707,280 B1 * 3/2004 Liu et al. ..... 323/224
7,126,317 B2 10/2006 Schreck
7,605,668 B2 10/2009 Fayneh et al.
7,728,688 B2 6/2010 Shor
2008/0054861 A1 3/2008 Zlatkovic
2008/0136472 A1 6/2008 Shor
2008/0136545 A1 6/2008 Fayneh et al.
2009/0079406 A1 * 3/2009 Deng et al. ..... 323/280
2009/0302812 A1 * 12/2009 Shor et al. ..... 323/223

* cited by examiner

*Primary Examiner* — Jeffrey L Sterrett
(74) *Attorney, Agent, or Firm* — Ryder, Lu, Mazzeo and Konieczny, LLC; Douglas J. Ryder

(57) ABSTRACT

In general, in one aspect, the disclosure describes a voltage regulator (VR) that includes a first amplifier receiving a first reference voltage and a feedback voltage as inputs. A second amplifier receiving a second reference voltage and an output of the first amplifier as inputs. A drive component (e.g., transistor(s)) coupled to the second amplifier to drive current to an output based on an output of the second amplifier. A shunt component (e.g., transistor(s)) coupled to the first amplifier to shunt current from the output based on the output of the first amplifier. Current variations in the shunt component are controlled.

18 Claims, 5 Drawing Sheets

LOW NOISE VOLTAGE REGULATOR

BACKGROUND

Multi-core microprocessors require many clock domains and hence many phase locked loops (PLL). The jitter requirements for PLL's on multi-core microprocessors are much more stringent, requiring a sigma jitter of 1.5 ps, compared to the standard 5-8 ps jitter typically associated with PLLs presently used. One possibility to achieve such a low jitter is to use an inductive-capacitive (LC) PLL. However, this requires the process to incorporate integrated inductors, which adds significant cost and complexity to the manufacturing. In addition, the LC PLLs have a very thin tuning range, which disqualifies them in many applications which require banding. Transistor-based low jitter PLL's have been suggested, but require on chip voltage regulators (VR) which have very low noise characteristics, referred to as low-noise voltage regulators (LNVR).

When there are many PLLs and VRs present on chip, the impedance of the VRs as seen from the analog power supply pin can cause the LC network on the package to oscillate. In digital microprocessor chips, the package network of the analog supply typically has much less supply traces than the digital supply. This may cause a relatively high inductance at this supply, namely several nH. For many VRs the phase of the impedance seen from the supply pin will become >90 degrees near the bandwidth of the VR (e.g., 100-200 MHz) which will cause negative real impedance. If the frequency that the impedance crosses from positive to negative is in the resonant range of the LC network (e.g., <500 MHz) and the inductance of the LC network is high enough, then oscillations can occur.

BRIEF DESCRIPTION OF THE DRAWINGS

The features and advantages of the various embodiments will become apparent from the following detailed description in which.

DESCRIPTION

Figure 1:
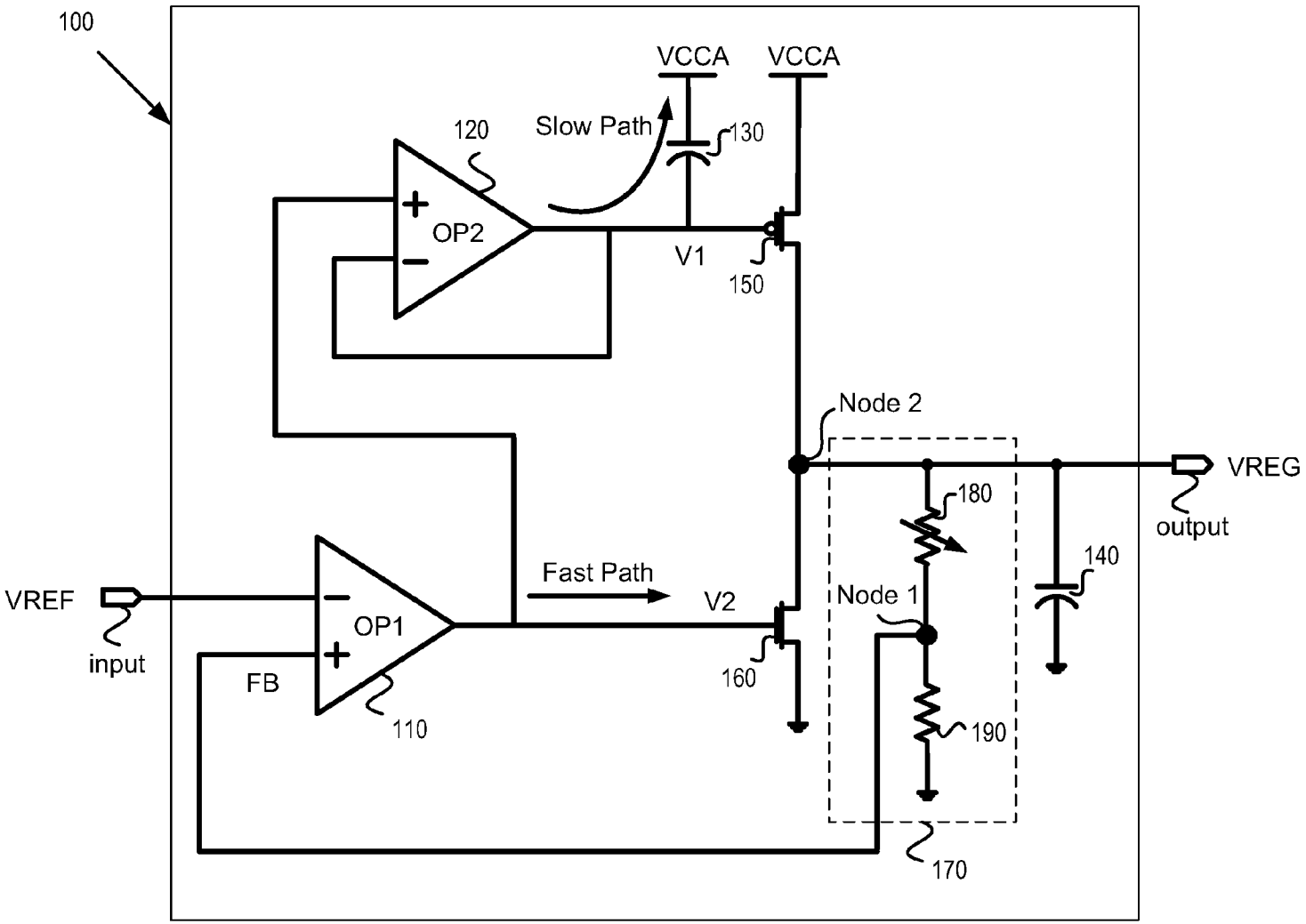
FIG. 1 (RELATED ART)
FIG. 1 illustrates a functional diagram of an example voltage regulator (VR)

FIG. 1 illustrates a functional diagram of an example voltage regulator (VR) 100 utilized to prevent negative real impedance. The VR 100 may include operational amplifiers (OP1, OP2) 110, 120, a drive component 150, and a shunt component 160. The VR 100 may also include capacitors 130, 140, and a divider 170. The divider 170 may divide the output of the VR 100 (VREG) and provide the divided output as feedback (FB). The OP1 110 may receive a reference voltage (VREF) and the FB from the divider 170 as the inputs and may provide an output voltage (V2). The divider 170 may be a resistor divider and include resistors 180, 190. The FB may be provided from a node between the resistors 180, 190 (node 1) where the values of the resistors 180, 190 may determine the multiplication factor between the FB (and VREF) and the VREG. The resistor 180 may be a variable resistor to enable a trimmable VREG for a fixed VREF. It should be noted that the divider 170 may not be utilized and the VREG (from node 2) may be directly provided to the OP1 110.

The VREF may be provided to the negative (inverting) terminal and the FB may be provided to the positive (non-inverting) terminal of the OP1 110. The output of the OP1 110 may be coupled to the shunt component 160 so that V2 is provided thereto. The shunt component 160 may be used to shunt the current from node 2 to a first supply (e.g., ground). The V2 applied to the shunt component 160 may control the amount of current that is shunted from node 2. The shunt component 160 may include one or more transistors. The shunt component 160 may include a negative channel transistor (e.g., NMOS). The shunt component 160 is illustrated as an NMOS transistor but is not limited thereto. The V2 may be coupled to a gate of a shunt transistor 160. The source of the shunt transistor 160 may be coupled to the first supply (ground) and the drain may be coupled to the output of the VR 100, the drain of the shunt transistor 150, the capacitor 140 and the divider 170 (node 2).

The OP2 120 may receive the V2 and its output (feedback) as input and may provide an output voltage (V1). The V1 may be provided to the negative (inverting) terminal and the V2 may be provided to the positive (non-inverting) terminal of the OP2 120. The OP2 120 may be configured as a unity-gain buffer so that V1 follows V2 (V1=V2). The output of the OP2 120 may be coupled to the drive component 150 so that V1 is provided thereto. The drive component 150 may be used to drive the current from node 2 to a second supply (e.g., voltage rail (VCCA)). The V1 applied to the drive component 150 may control the amount of current that is driven to node 2. The drive component 150 may include one or more transistors. The drive component 150 may include a positive channel transistor (e.g., PMOS). The drive component 150 is illustrated as a PMOS transistor but is not limited thereto. The V1 may be coupled to a gate of a drive transistor 150. The source of the drive transistor 150 may be coupled to the second supply (VCCA) and the drain may be coupled to node 2 (the output of the VR 100, the drain of the shunt transistor 160, the capacitor 140 and the divider 170).

The capacitor 130 may be used to insert a low bandwidth pole at the output of OP2 120 and may also improve the power supply rejection ratio (PSRR) of the VR 100 by enabling the drive transistor 150 to better reject VCCA noise. The capacitor 140 may be a decoupling capacitor used to decouple the output of the VR 100.

The OP1 110 and the shunt transistor 160 may provide a first path to the output. The first path may be a fast path that may provide an AC high bandwidth path to enable fast corrections for any changes in the output voltage. The OP2 120 and the drive transistor 150 may provide a second path to the output. The second path may be a slow path that may provide a DC low bandwidth path to ensure the gate of the drive transistor 150 does not change too quickly which may prevent the VR 100 from having a negative impedance as seen from the second supply (VCCA).

In operation, when there is a change in the VREG (as detected by OP1 110 comparing FB and VREF), the OP1 110 may adjust the V2 (voltage applied to shunt transistor 160) quickly to compensate and the shunt transistor 160 accordingly may quickly adjust the amount of current shunted from node 2. The OP2 120 may also adjust the V1 (voltage applied to the drive transistor 150) slowly and the drive transistor 150 may accordingly slowly adjust the amount of current passed to node 2.

If the FB were to increase above VREF, the OP1 110 may increase the V2, and the OP2 120 may increase the V1 since it is configured as a unity-gain buffer. The increased V1 may reduce the magnitude of the gate-to-source voltage (Vgs) of the drive transistor 150 which may cause the drive transistor 150 to source less current to node 2 thereby counteracting the increased VREG and FB. The increased V2 may increase the magnitude of the Vgs of the shunt transistor 160 which may cause the shunt transistor 160 to shunt more current from node 2 thereby also counteracting the increased VREG.

If the FB were to decrease below VREF, the OP1 110 may decrease the V2 and the OP2 120 may accordingly decrease the V1. The decreased V1 may increase the magnitude of the Vgs of the drive transistor 150 which may cause the drive transistor 150 to source more current to node 2 thereby counteracting the decreased VREG and FB. The decreased V2 may decrease the magnitude of the Vgs of the shunt transistor 160 which may cause the shunt transistor 160 to shunt less current from node 2 thereby also counteracting the decreased VREG.

The lower bandwidth of OP2 120 may mean that the magnitude of the Vgs of the drive transistor 150 is changed (increased or decreased) at a slower rate than the Vgs of the shunt transistor 160 so that the adjustment to the current provided by the drive transistor 150 is slower than the adjustment to the current shunted by the shunt transistor 160. The quick adjustment of the shunt transistor 160 current may compensate for any changes in the current provided by the drive transistor 150 which may be caused by variations in the second supply (VCCA). The total current flowing out of the VR 100 at its output may stay constant. This may assist in the PSRR of the VR 100.

The capacitor 130 between V1 and VCCA may strongly couple the gate of the drive transistor 150 to its source. Thus, when the power supply (second source) changes at high frequency, this change is delivered to the gate of drive transistor 150 so that the Vgs stays stable. This may help stabilize the current in the drive transistor 150 and assist in the PSRR.

The adjustment of the V1 may slowly return the VR 100 to a DC condition. Since the gate of the drive transistor 150 may be changed slowly, the gate of the drive transistor 150 may not be overshoot. The VR 100 may accordingly exhibit only positive impedance as seen by the input supply (VCCA) and avoid problems (e.g., oscillations) caused by negative impedance at certain phases. By utilizing a fast path and a slow path, the OP1 110 and the OP2 120 may be kept in phase. The VR 100 may provide a PSRR in the approximate range of 20-30 dB.

The OP2 120 being configured as a unity-gain buffer (as a follower to OP1 110) so that V2=V1 may result in the voltage required at the gate of the drive transistor 150 (V1) being used to determine the DC voltage at the gate of the shunt transistor 160 (V2). The voltage at gate of drive transistor 150 (V1) may equal VCCA−Vgs of the drive transistor 150. Thus, V1 may vary as a function of VCCA, threshold voltage (Vth) of the drive transistor 150 and the current required to be passed by the drive transistor 150. Accordingly, the V2 may vary as a function of V1 (VCCA, Vth, I) as well as a function of Vth of shunt transistor 160 and the current required to be shunted by the shunt transistor 160. Accordingly, the current shunted by the shunt transistor 160 may vary over at wide range based on process, voltage and temperature (PVT) variations in the shunt transistor 160, the drive transistor 150 and VCCA. The wide current swing of the shunt transistor 160 for PVT variations may result in the VR 100 being inefficient (shunt transistor 160 drawing too much or not enough current). This effect may also cause a lower performance in the VR 100.

Tightening the current spread in the shunt transistor 160 may improve the performance of a VR beyond the limitations of the example VR 100 of FIG. 1. Current control techniques may be utilized to achieve a tighter current range (limit current swing due to PVT variations) for the shunt transistor 160 and may substantially improve the performance of the VR. The current control techniques may include using a reference voltage as input to the OP2 120 rather than V1. Using a reference voltage rather than V1 may eliminate current variations in the shunt transistor 160 caused by the PVT variations associated with the drive transistor 150 and VCCA. The performance improvements may include enhanced PSRR, reduced thermal noise, better power efficiency, and higher accuracy. The performance improvements may enable the VR to act as a low noise VR (LNVR).

Figure 2:
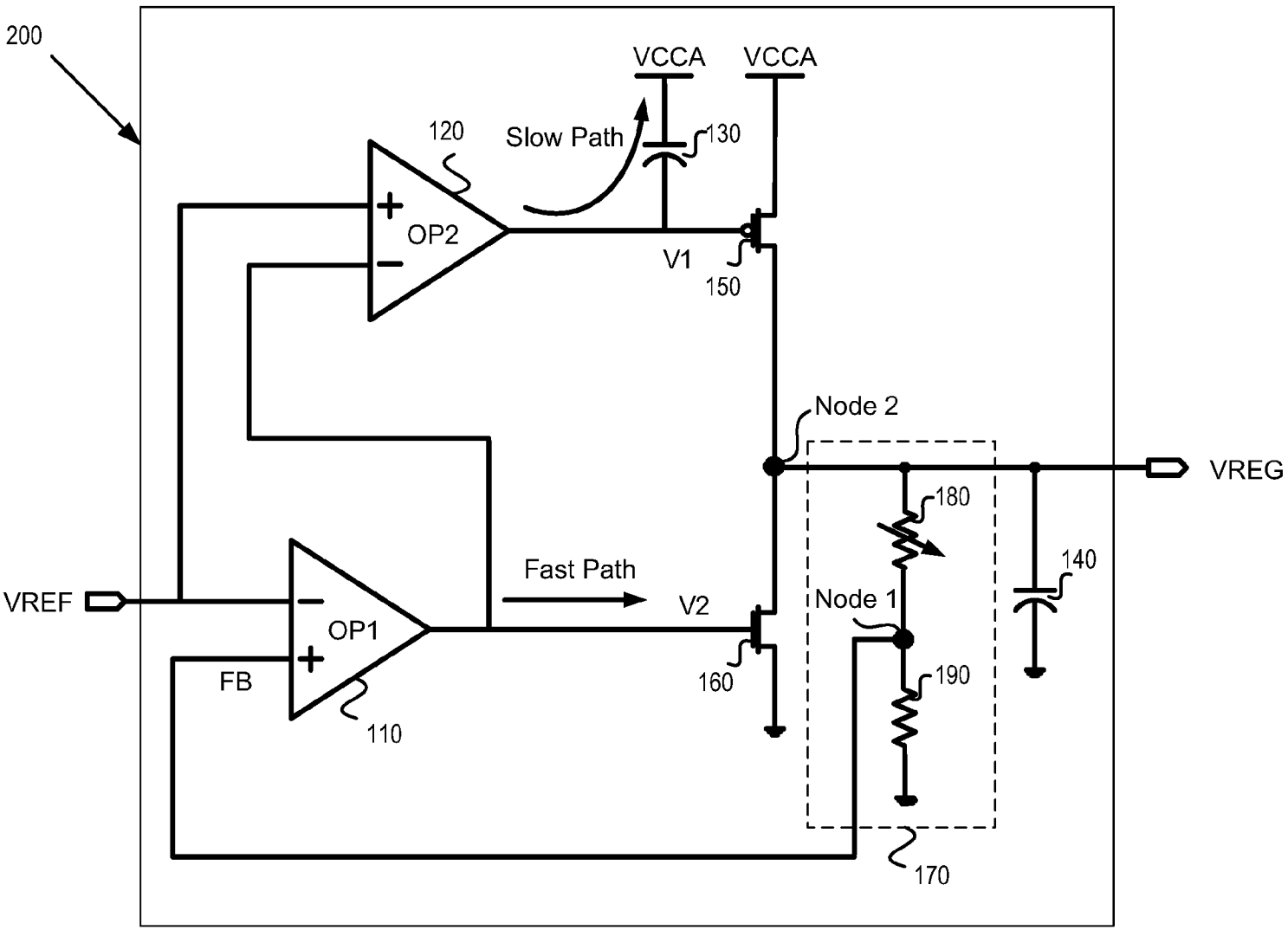
FIG. 2 illustrates a functional diagram of an example low noise VR (LNVR), according to one embodiment.

FIG. 2 illustrates a functional diagram of an example LNVR 200. The LNVR 200 may include the same components as the VR 100. The LNVR 200 may use the same reference voltage (VREF) as input for both operational amplifiers (OP1 110, OP2 120) to provide tighter control of the shunt component (e.g., transistor(s)) 160 current. The OP2 120 may receive the VREF (the input of the VR 200 and the OP1 1110) and the V2 (output of the OP1) as inputs. The VREF may be provided to the positive terminal and the V2 may be provided to the negative terminal of the OP2 120. The OP2 120 (the slow path) may be used to drive V2 towards the VREF. Accordingly, the V2 provided to the shunt transistor 160 may be based on the VREF rather than V1 so that the PVT variations in the drive component (e.g., transistor(s)) 150 and VCCA may not effect the current shunted by the shunt transistor 160. Accordingly, the current shunted by the shunt transistor 160 may vary to a much lesser degree (the current is more controlled).

Figure 3:
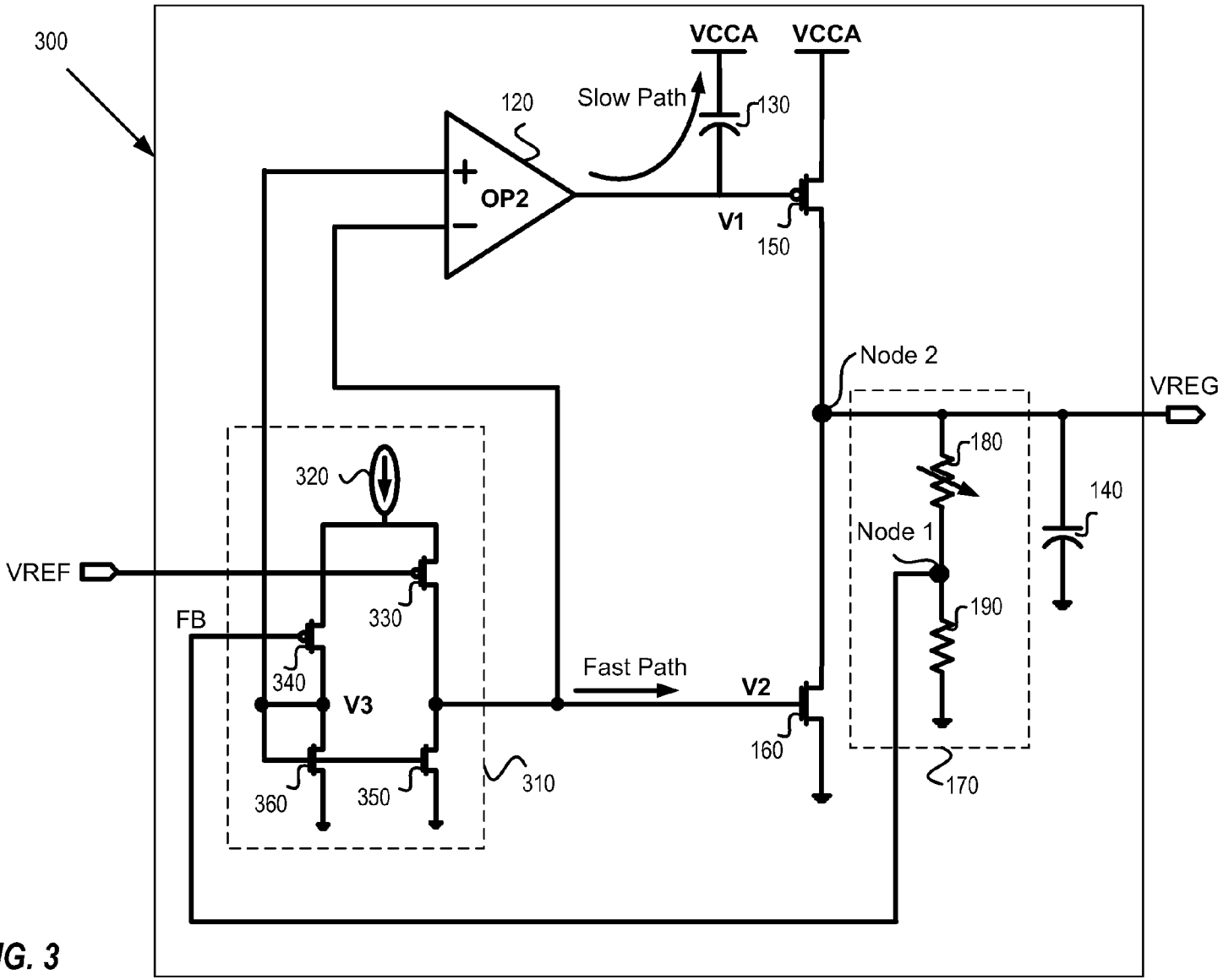
FIG. 3 illustrates a functional diagram of an example LNVR having tighter current control and increased DC gain, according to one embodiment.

FIG. 3 illustrates a functional diagram of an example LNVR 300 having tighter control of the shunt transistor current. The LNVR 300 may include an OP1 310 and many of the same components as the LNVR 200. The LNVR 300 may use separate reference voltages for each operational amplifier. The OP1 310 may be a simple differential stage and include a current source 320, and transistors 330, 340, 350, 360. The transistors 330, 340 may be positive channel transistors (e.g., PMOS) and the transistors 350, 360 may be negative channel transistors (e.g., NMOS). The transistor 330 and the transistor 350 may be coupled between the current source 320 and ground in parallel to the transistor 340 and the transistor 360 that may be also be coupled between the current source 320 and ground. The source of the transistors 330, 340 may be coupled to the current source 320 and the drains may be coupled to the source of the transistors 350, 360. The drain of the transistors 350, 360 may be coupled to ground.

The gate of the transistor 330 may receive the VREF and the gate of the transistor 340 may receive the FB from node 1. The gates of the transistors 350, 360 may be connected to an output voltage (V3) node of the transistor stack 340, 360. The reference voltage provided as an input to the OP2 120 may be V3. The V3 may be provided to the positive terminal and the V2 may be provided to the negative terminal of the OP2 120. The OP2 120 (the slow path) may be used to drive the V2 towards the V3.

The V2 and the V3 being the same may create a virtual current mirror between the transistors 160, 350, 360. All of these currents may be a multiple of the current source 320. The current source 320 may be generated by a central current reference, or any other current source. For example, a constant, trimmable PVT-independent current source may be utilized. In this configuration, the current in the transistor 360 may be derived from the current source 320, while the currents in the transistors 350, 160 may be derived from the current in the transistor 360 and hence also from the current source 320. Accordingly, the V3 node may be referred to as the current mirror node and the transistor 360 may be referred to as the current mirror transistor.

The V2 being driven to V3 limits the swing in the current driven by the transistor 160 due to PVT variations. In addition to the current control, the DC gain of the LNVR 300 may be higher since the drains of the transistor and the transistor 350, 360 are regulated by the OP2 120 (V2 and V3 are the inputs). The DC gain of the LNVR 300 is thus determined by both the fast path through the OP1 310 and the slow path through the OP2 120. The AC gain is determined by the fast path which is the much higher bandwidth path.

By controlling the currents in the OP1 310 and in the shunt transistor 160, one can increase the bandwidth and thus significantly improve performance in terms of the parameters mentioned earlier.

Figure 4:
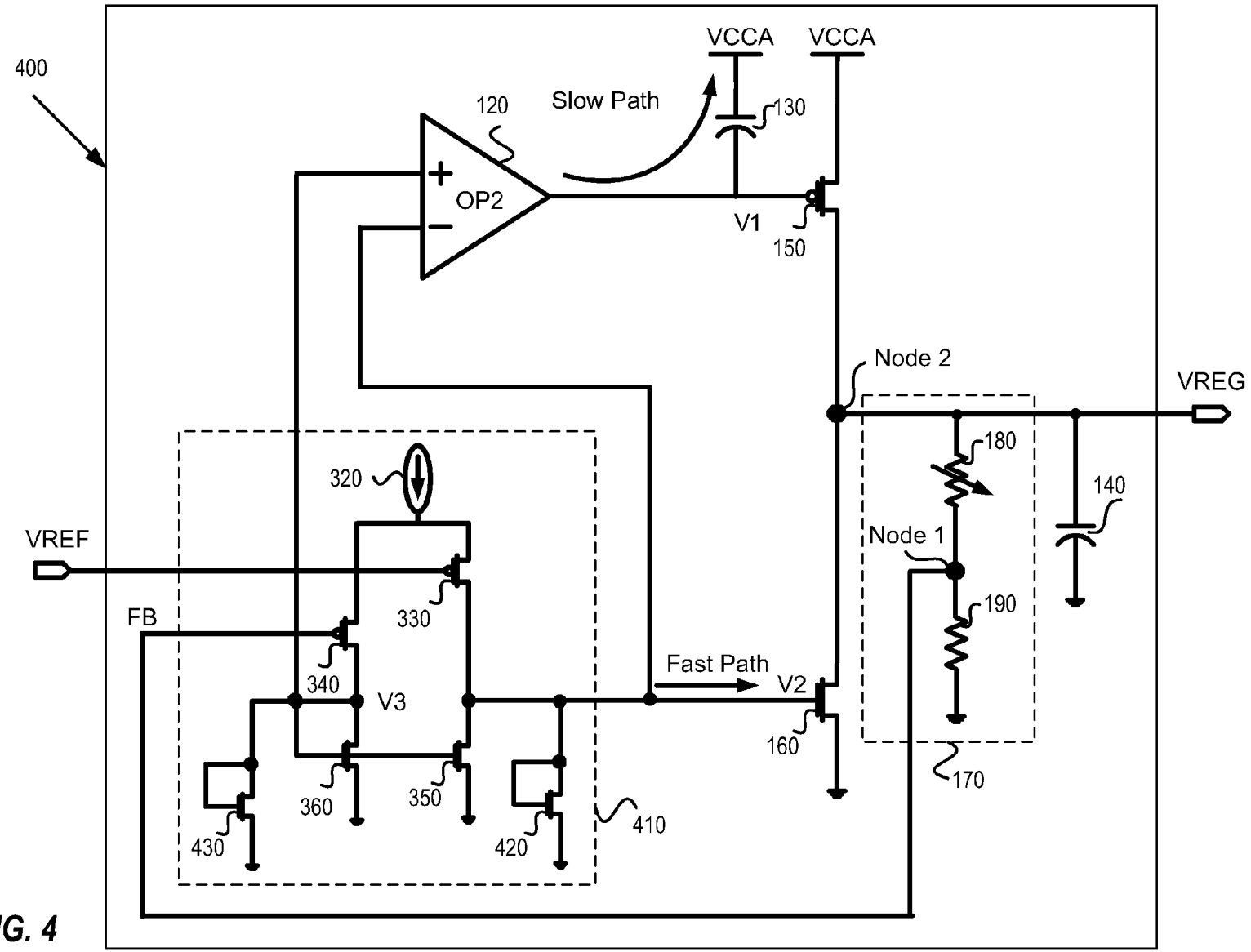
FIG. 4 illustrates a functional diagram of an example LNVR having increased fast path bandwidth, according to one embodiment.

FIG. 4 illustrates a functional diagram of an example LNVR 400 having tighter control of the shunt transistor current and increased fast path bandwidth. The LNVR 400 may include many of the same components as the LNVR 300 and the operational amplifiers may utilize the same reference voltages as the LNVR 300 (different reference voltages for each operational amplifier). The LNVR 400 may include an OP1 410 that is similar to the OP1 310 but that has its gain reduced in exchange for additional bandwidth. The gain may be reduced through any number of means. For example, the OP1 410 may include diodes (e.g., diode connected transistors) 420, 430 coupled between V2 and V3 respectively and ground. The transistors 420, 430 may be negative channel transistors (e.g., NMOS). The drain of the transistors 420, 430 may be coupled to V2 and V3 respectively, the sources may be coupled to ground, and the gates may be connected to the drains.

Since V2 and V3 may be at the same voltage, the transistors 420, 430 may reduce the DC gain of the fast path which allows an increase in the bandwidth. The DC gain of the fast path may be reduced without affecting performance of the LNVR 400 due to the increase in the DC gain caused by regulating the drains of the transistors 350, 360 (discussed above with respect to FIG. 3). The decreased gain in the fast path may increase the stability of the LNVR 400 and enable the bandwidth in the fast path to increase. The high bandwidth, high transconductance (gm) and current control of the fast path may enable the LNVR 400 to improve thermal noise and PSRR performance.

The performance of the LNVRs 300, 400 may be directly dependent on the current source 320. Utilizing a trimmable PVT-independent current source as the current source 320 enables the current provided to be adjusted. For example, the current may be increased when the LNVR 300, 400 is utilized in applications where better PSRR/noise properties are desired. The current may be decreased for lower power or lower performance applications. The adjustment of the current and performance of the LNVR 300, 400 may be useful in applications where only some of the PLLs, such as the peripheral component interconnect (PCI), require very high jitter performance, and other PLLs can function at lower power with a compromise in the PSRR and noise. The LNVRs 300, 400 may be configurable by trimming the current source 320 current so that in critical applications it can achieve very high performance, and in less critical applications it can be low power (current efficient).

The LNVRs 200, 300, 400 provide very good control of the current in the shunt transistor by driving the output of the OP1 1110, 310, 410 (V2) to a steady reference voltage (VREF, V3). The separation between the AC and DC gain paths enables high gain and accuracy in the DC path without affecting stability. The AC path has a lower gain, but much higher bandwidth, which enables lower thermal noise and better PSRR. The LNVRs 200, 300, 400 may achieve greater than 42 dB of PSRR. The LNVRs 200, 300, 400 may keep the impedance phase below 60 degrees at the frequencies of interest and may keep the real impedance from becoming negative.

The LNVRs 200, 300, 400 may be utilized to drive PLLs, specifically LNPLLs. As there are several sources of noise in the LNPLL, it is highly desirable to minimize the VR noise as much as possible in order to meet the jitter limits for LNPLLs utilized in multicore processors (e.g., 1.5 ps). The noise in the LNVRs 200, 300, 400 may have a negligible effect on the overall jitter of a LN PLL.

The LNVRs 200, 300, 400 may be fabricated using only CMOS devices and can be used to drive LN PLLs fabricated using only CMOS devices which provides significant cost and complexity advantage.

Figure 5:
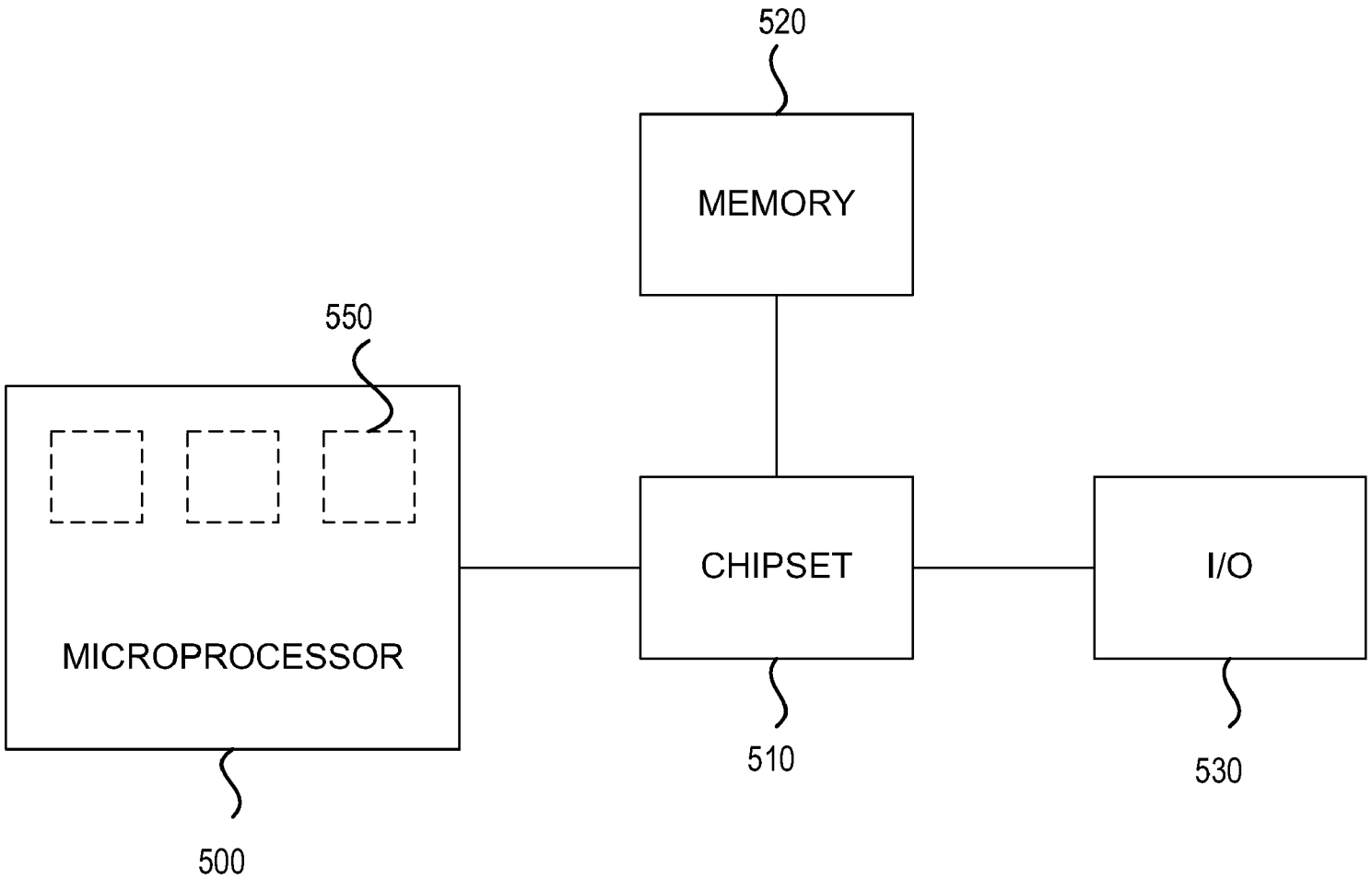
FIG. 5 illustrates a simplified high level diagram of a portion of computer system that may utilize a LNVR, according to one embodiment.

FIG. 5 illustrates a simplified high level diagram of a portion of computer system. The computer system may include a microprocessor 500, a chipset 510, memory 520 and input/output (I/O) components 530. The microprocessor 500 may communicate with the chipset 510 and the chipset 510 may provide communications to the memory 520 and I/O components 530. The microprocessor 500 may be a single core microprocessor, a multi-core microprocessor, or multiple microprocessors. The single core or multi-core microprocessors may be fabricated on the same die or may be fabricated on multiple dies. The chipset 510 may include one or more distinct integrated circuits (IC) and each IC may include one or more distinct die. The memory 520 may be various types of memory devices and may be a hierarchy of memory. The I/O components 530 can be any type of I/O device.

The various embodiments of the LNVR described herein (e.g., 200, 300, 400) may be implemented in the microprocessor 500 as LNVR 550. The LNVR 550 may provide regulated voltages to loads, for example, PLLs that are used within the microprocessor 500. The various embodiments of the LNVR may also be implemented in the other computer system components. The various embodiments of the LNVR are not limited to being implemented in computer systems. Rather, the various embodiments of the LNVR may be implemented in any number of systems or components requiring regulated voltages, for example systems or components that desire low noise regulated voltages or the ability to obtain a low noise regulated voltage when desired.

Although the disclosure has been illustrated by reference to specific embodiments, it will be apparent that the disclosure is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed is:

1. A computer system comprising memory; and a processor in communication with the memory, wherein the processor includes a voltage regulator, wherein the voltage regulator comprises a first amplifier receiving a first reference voltage and a feedback voltage as inputs;

a second amplifier receiving a second reference voltage and an output of the first amplifier as inputs;

a drive component coupled to the second amplifier to drive current to an output of the voltage regulator based on an output of the second amplifier; and a shunt component coupled to the first amplifier to shunt current from the output of the voltage regulator based on the output of the first amplifier, wherein arrangement of the first amplifier, the second amplifier, the drive component and the shunt component control current variations in the shunt component due to process, temperature, and voltage (PVT) variations.

2. The system of claim 1, wherein the first and the second reference voltages are the same.

3. The system of claim 1, wherein the first amplifier includes a central programmable current source and the second reference voltage is derived from the central programmable current source, and the current in the shunt component is derived from the central programmable current source.

4. A low noise voltage regulator (LNVR) comprising a drive component to drive current to an output of the LNVR;

a shunt component to shunt current from the output of the LNVR;

a first amplifier to drive the shunt component, wherein the first amplifier receives a feedback voltage and a first reference voltage as inputs and provides a first output to the shunt component; and a second amplifier to drive the drive component, wherein the second amplifier receives the first output and a second reference voltage as inputs and provides a second output to the drive component, wherein arrangement of the first amplifier, the second amplifier, the drive component and the shunt component provides a current control technique to limit current variations in the shunt component due to process, temperature, and voltage (PVT) variations.

5. The LNVR of claim 4, wherein the shunt component includes a shunt transistor and the drive component includes a drive transistor.

6. The LNVR of claim 5, further comprising a capacitor connected from a gate of the drive transistor to its source.

7. The LNVR of claim 4, wherein the feedback voltage is a divided version of the output of the LNVR.

8. The LNVR of claim 4, wherein the first amplifier includes a current mirror node and the second reference voltage is provided from the current mirror node.

9. The LNVR of claim 8, wherein the first amplifier includes a central current source and current in the first amplifier is derived from the central current source.

10. The LNVR of claim 9, wherein the central current source is a programmable central current source.

11. The LNVR of claim 8, wherein the first amplifier includes diodes to convert amplifier gain to bandwidth.

12. The LNVR of claim 4, wherein the first and the second reference voltages are the same.

13. A low noise voltage regulator (LNVR) comprising a first amplifier receiving a first reference voltage and a feedback voltage as inputs;

a second amplifier receiving a second reference voltage and an output of the first amplifier as inputs;

a drive component coupled to the second amplifier to drive current to an output of the LNVR based on an output of the second amplifier; and a shunt component coupled to the first amplifier to shunt current from the output of the LNVR based on the output of the first amplifier, wherein arrangement of the first amplifier, the second amplifier, the drive component and the shunt component control current variations in the shunt component due to process, temperature, and voltage (PVT) variations.

14. The LNVR of claim 13, wherein the first and the second reference voltages are the same.

15. The LNVR of claim 13, wherein the first amplifier includes a central programmable current source and the second reference voltage is derived from the central programmable current source, and the current in the shunt component is derived from the central programmable current source.

16. The LNVR of claim 13, wherein the first amplifier includes a current mirror node and the second reference voltage is provided from the current mirror node.

17. The LNVR of claim 16, wherein the first amplifier includes diode connected transistors to convert amplifier gain to bandwidth.

18. The LNVR of claim 13, wherein the first amplifier and the shunt component provide a fast path adjustment to the output current and the second amplifier and the drive component provide a slow path adjustment to the output current.

* * * * *